United States Patent [19]

Holmes et al.

[11] 4,398,650

[45] Aug. 16, 1983

[54] ENERGY ABSORBING CORRUGATED PAPER CONTAINER

[75] Inventors: Henry C. Holmes, Brooklyn Center; Roderick D. Johnson, Southeast Minneapolis, both of Minn.

[73] Assignee: International Paper Company, New York, N.Y.

[21] Appl. No.: 968,043

[22] Filed: Dec. 8, 1978

[51] Int. Cl.[3] ..... B65D 5/56

[52] U.S. Cl. ..... 220/443; 156/177; 156/178; 220/71; 229/23 R; 229/DIG. 2; 428/113; 428/184

[58] Field of Search ..... 220/441, 443, 71; 428/110, 111, 114, 184, 182, 186, 113; 156/176, 177, 178, 179, 205, 206; 229/23 R, DIG. 2

[56] References Cited

U.S. PATENT DOCUMENTS

| | | | |
|---|---|---|---|
| 1,184,749 | 5/1916 | Hicks | 428/186 |
| 1,335,058 | 3/1920 | Jackson, Jr. | 428/110 |
| 1,605,953 | 11/1926 | Howard | 428/113 |
| 1,987,461 | 1/1935 | Boeye | 220/441 X |
| 2,221,309 | 11/1940 | Gazelle | 428/186 |
| 2,749,013 | 6/1956 | Wilkinson | 220/441 |
| 3,308,006 | 3/1967 | Kresse et al. | 428/182 X |
| 3,314,841 | 4/1967 | Romanin | 156/179 |
| 3,404,748 | 10/1968 | Bjorksten | 428/182 X |
| 3,511,739 | 5/1970 | Hebberlins | 428/110 X |
| 3,553,064 | 1/1971 | Wideman | 428/113 |

FOREIGN PATENT DOCUMENTS

| | | | |
|---|---|---|---|
| 17549 | of 1898 | United Kingdom | 156/177 |

*Primary Examiner*—Allan N. Shoap

*Attorney, Agent, or Firm*—Walt Thomas Zielinski

[57] ABSTRACT

A reinforced corrugated paper product and container made thereof are disclosed having one or more reinforcing strands placed between the outer liner and the corrugated medium in one or more curvilinear paths. Also disclosed is a method of making the reinforced corrugated paper product.

7 Claims, 9 Drawing Figures

ENERGY ABSORBING CORRUGATED PAPER CONTAINER

BACKGROUND OF THE INVENTION

This invention relates to reinforced corrugated paperboard and more particularly to containers made of reinforced corrugated paperboard. This invention is particularly concerned with a reinforced bin for relatively heavy palletized loads which are to be moved from place to place.

The paperboard bin shown in U.S. Pat. No. 3,945,558 has found considerable use in the meat processing industry. Such a bin is preferably made of corrugated paperboard and may be of single wall or double wall construction. One use for such a bin is the temporary storage and the movement within a meat packing plant, or from plant to plant, of animal parts, including organs. The bin is palletized to facilitate handling. The load or cargo carried by the bin usually includes internal organs and animal liquids so that the cargo exhibits hydraulic characteristics. A loaded bin may typically carry as much as 1100 to 2500 pounds of animal parts and organs. A loaded bin tends to assume a circular shape, in plan view, under the influence of the hydraulic pressure imparted therein by its cargo.

The movement of a loaded palletized bin within a meat packing plant or from plant to plant invariably involves subjecting the bin to considerable acceleration and shock forces. Such forces create momentary peaks in the internal pressure which substantially raise the hoop stress in the walls of the container. The resulting peaks in hoop stress, which assume the greatest value in the lower portion of the container, may exceed the strength of the container walls. A tear of the outer liner may begin at an inherently weakened portion thereof, for example, at a score line. Once such a tear begins, the hoop stress becomes more concentrated at the root of the tear causing the tear to rapidly propagate upwards along the wall. The result is a catastrophic failure of the bin. Such failures are most likely to happen during an acceleration load or shock applied to the bin while it is being moved or when it is being trucked. The successive acceleration or shock forces may tend to increase the effective hoop stress in the lower portions of the bin several fold.

Patent U.S. Pat. No. 1,605,953 teaches a reinforced corrugated paper product. The reinforcement is in the form of a rectangular grid pattern of reinforcing strands sandwiched between two sheets of paper which form the liner of the corrugated paper product. Of necessity, one set of strands will be parallel to the flutes of the corrugated medium and the other set will be generally perpendicular to the corrugated medium. If a bin is constructed of such a corrugated paper product with the corrugated flutes preferably in a vertical direction, some of the vertically oriented reinforcing strands will fail to register with the flutes of the corrugated medium thereby doing little to enhance the strength of the container. On the other hand, the horizontal strands will be circumferentially aligned passing successively over each of the flutes of the corrugated medium. Such strands will tend to absorb the hoop stress to which a container made thereof may be subjected. However, as such stresses are successively applied, the horizontal strands will tend to cut through the medium or the liner because the length of each strand is essentially the same as the circumference of the container. Also, each strand is firmly held in place and lacks any elastic behavior. As a result, the usefulness of such a container is limited to a distinct load and number of successive acceleration loads and shocks.

SUMMARY OF THE INVENTION

In accordance with one aspect of the invention, a reinforced corrugated paper product in sheet form is provided having an axial direction in the machine direction of manufacture and a transverse direction generally perpendicular thereto and which includes an outer liner, an inner liner, a corrugated medium adhesively secured between the outer liner and the inner liner, the corrugated medium having its flutes extending generally in the transverse direction, and a reinforcing strand adhered between the outer liner and the corrugated medium. The reinforcing strand is so positioned as to define a curvilinear path extending generally in the axial direction.

In accordance with another aspect of the invention, a plurality of reinforcing strands is adhered between the outer liner and the corrugated medium. Each of the reinforcing strands is so positioned as to define a continuous curvilinear path having an axis of symmetry which extends generally in the axial direction.

In accordance with another aspect of the invention, a double walled reinforced corrugated paper product is provided having an inner liner, an intermediate liner, and inner corrugated medium adhesively secured between the inner liner and the intermediate liner, an outer liner, an outer corrugated medium adhesively secured between the outer liner and the intermediate liner, and a plurality of reinforcing strands adhesively secured to one of the surfaces of the intermediate liner or to the inner surface of the outer liner. The reinforcing strands are positioned so as to define a family of essentially parallel continuous sinusoidal paths having sinusoidal axes extending generally in the axial, or machine, direction.

In accordance with yet another aspect of the invention, a corrugated paper container is provided which is particularly suitable for containing a cargo during transportation and handling and for resisting acceleration forces and shock which may be experienced during such transportation and handling. The corrugated paper container includes a plurality of upstanding side walls and a bottom wall wherein the side walls are comprised of an outer liner, an inner liner defining the inner surface of the side walls, a corrugated medium adhesively secured between the outer liner and the inner liner with its flutes extending generally in a vertical direction, and at least one reinforcing strand adhered between the outer liner and the inner liner. The reinforcing strand is so positioned as to define an essentially continuous curvilinear path extending generally in a horizontal direction and circumscribing the container.

In accordance with yet another aspect of the invention, a method of making a reinforced corrugated paper product in sheet form is provided which includes the steps of corrugating a fluting medium, adhesively securing a liner to the corrugated medium thereby providing a single faced corrugated paper, providing a second liner and continuously feeding the second liner into a closure nip, applying adhesive to the exposed flutes of the single faced corrugated paper, continuously feeding the single faced corrugated paper into the closure nip in an angular relationship to the feeding of the second liner, continuously feeding a reinforcing strand into the closure nip between the second liner and the single faced corrugated paper, reciprocating the reinforcing strand while performing its feeding step. The reciprocating step is performed in a direction essentially transverse to the direction of movement of the liner into the closure nip. The additional step is provided of applying pressure at the outlet of the closure nip to the single faced corrugated paper and the second liner to adhesively secure the single faced corrugated paper to the second liner with the reinforcing strand there between.

In view of the foregoing, it is an object of the invention to provide a reinforced corrugated paper product.

It is also an object of the invention to provide a reinforced corrugated paper container capable of withstanding considerable shock and acceleration forces when in use.

It is yet another object of the invention to provide a method of making a reinforced corrugated paper product useful in the aforementioned reinforced container.

DETAILED DESCRIPTION OF THE PREFERRED EMBODIMENTS OF THE INVENTION

Figure 1:
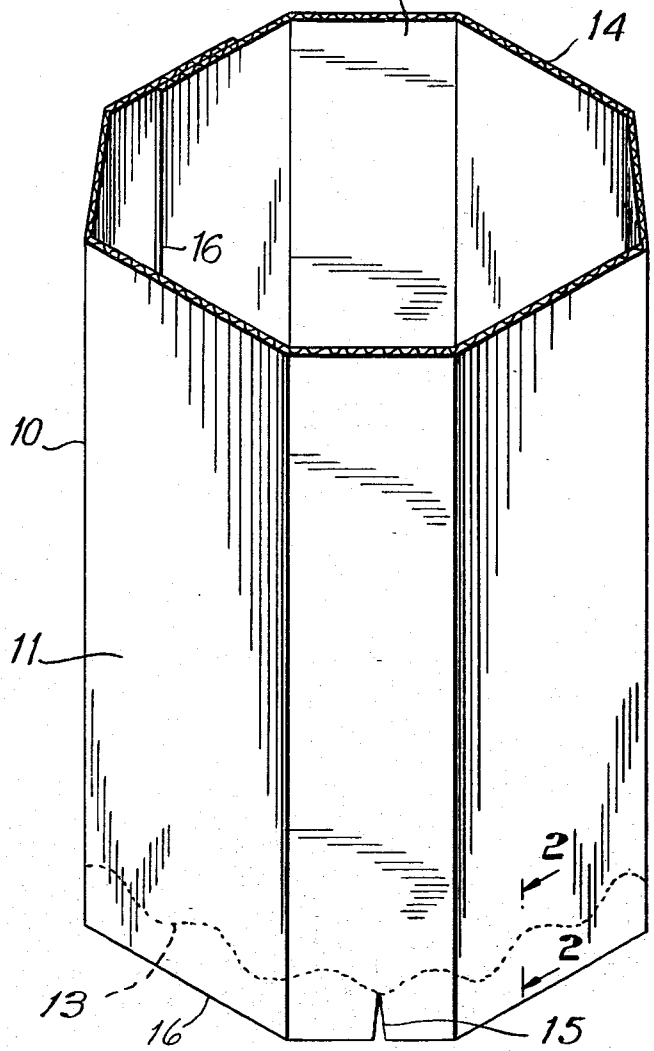
FIG. 1 is a three dimensional view of a corrugated paper bin including a reinforcing strand in accordance with principles of the invention.

Referring now to FIG. 1, there is illustrated a corrugated paper bin having an outer liner 11 and an inner liner 12 and a bottom wall 16. A reinforcing strand 13 is shown in invisible line notation circumscribing the bin. The reinforcing strand is adhered between the outer liner 11 and the corrugated medium. The corrugated medium is identified as 14.

The reinforcing strand 13 is preferably made of unspun rayon fibers and has a total tensil strength in the range of 20 to 60 pounds. The reinforcing strand is coated with a flexible thermoplastic resin having an appropriate softening point selected to enable the reinforcing strand to become adhered in place under the temperature and pressure conditions prevailing in the double facer section of a conventional corrugating machine.

Rayon is the preferred material of the reinforcing strand as distinguished from the more hydrophilic materials, such as, for example, cotton, because the rayon absorbs far less water away from the water/starch adhesive used to adhere the outer liner to the corrugated medium.

By way of illustration, a tear 15 of the outer liner is shown presumably caused by transportation shock. The tear is illustrated progressing from the bottom of the bin up to but stopping at the reinforcing strand 13.

The reinforcing strand is shown in FIG. 1 as lying in an essentially continuous curvilinear path circumscribing the container. The term curvilinear is used in the sense that the circumferential path occupied by the strand is greater than the circumference of the bin. The path is said to be essentially continuous while, nevertheless, it is to be understood that at the overlap seem 16, the position of the reinforcing strand in one end of the blank used to fabricate the bin needs not register with the position of the reinforcing strand in the other end of the blank.

If the bin 10 is loaded with a cargo of animal parts including organs and animal liquids, a considerable hydraulic pressure is developed in the lower portions of the bin. The loaded bin will distort somewhat tending to assume a circular shape under the influence of the internal pressure. The walls of the bin will be subjected to several stresses, the predominating one being in the nature of a hoop stress. The hoop stress acts in a fashion tending to cause tensil failure of the walls in a circumferential direction.

If a loaded bin is subjected to handling and/or transportation, such as trucking, it experiences considerable shock and acceleration forces. These forces, while momentary in nature, create sharp increases in the aforementioned stresses. When the tensil strength of the outer or inner liner is exceeded by such a momentary stress increase a tear will develop, typically in the lower portion thereof, and will rapidly propagate up along the wall. Once such a tear begins, the ability of the bin to absorb further energy resulting from further shock loads is drastically diminished and a gross failure of the bin will occur.

Clearly, an effective bin for transportation uses requires the ability to absorb considerable shock energy before failure. The successive shock and acceleration forces incurred during transportation and handling call upon the bin to absorb successive impulses of energy. A bin in accordance with the principles of the present invention is capable of absorbing such successive impulses of energy before failure.

Figure 2:
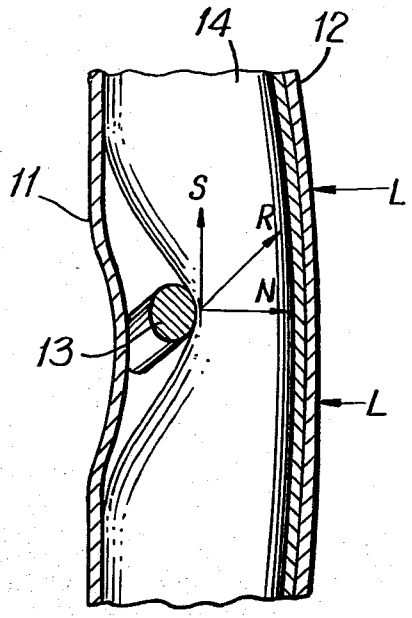
FIG. 2 is a partial cross-sectional view of a wall of the bin of FIG. 1 illustrating the distortion of the walls when under stress.

The manner in which the energy is absorbed can be understood in reference to FIG. 2 which is an enlarged cross-sectional view of a wall of the bin of FIG. 1 taken along the line 2—2. The reinforcing strand 13 is shown distorting the corrugated medium 14 under the action of load forces L acting on the inner liner. A vector diagram shows the forces N, R, and S which the reinforcing strand tends to apply to the medium 14. The force N is a crushing force acting normal to the plane of the bin's wall. This force defines the direction of the failure mode to be expected of a bin having a reinforcing strand which is not arranged in a curvilinear path. Such failure is manifested by the reinforcing strand cutting through the medium into the inner liner.

The vector S represents the sidewise force the curvilinearly disposed string applies to the medium as a consequence of its tendency to attempt to straighten from its curvilinear path into a circumferential path. The vector R represents the resulting force the reinforcing strand 13 tends to apply to the medium 14.

As the bin is subjected to transportation shocks and momentary acceleration forces, the strand 13 distorts the medium in the R direction. If the forces are great enough, the strand will also break its localized bonds with the medium and liner and move in the S direction. Each shock load will cause further distortion and the absorption of energy before the reinforcing strand ultimately fails. Thus, upon absorbing the energy resulting from a first momentary shock load which may involve partial local failure of the medium, the integrity of the wall is maintained and the bin is capable of absorbing additional impulses of energy. A certain quasi-elastic behavior of the bin results.

If a tear of the outer liner commences at the bottom of the bin, its tendency to progress upwards will be stopped by the reinforcing strand. If a second reinforcing strand is employed and positioned in a curvilinear path above the first reinforcing strand, a generalized relieving of the tensil stresses in the liner results by a redistribution of the stress concentration occuring at the root of the tear so that the stresses are once again more uniformly redistributed around the bin by the reinforcing strands.

Figure 3:
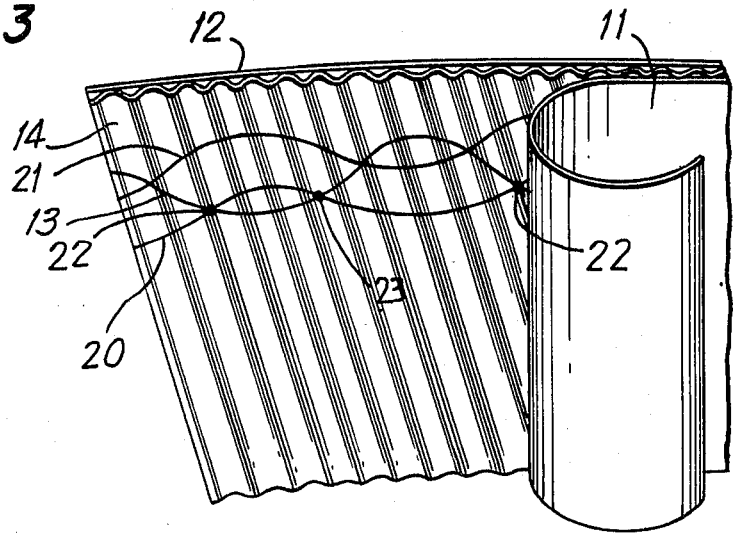
FIG. 3 is a three dimensional view of a corrugated paper product showing a plurality of strands placed between an outer liner and the corrugated medium in accordance with principles of the invention.

Referring now to FIG. 3, a reinforced corrugated paper product in sheet form is shown having a liner 11 intended as the outer liner of a bin or corrugated container to be made from such corrugated paper product. A second liner, intended as the inner liner 12, is shown together with a corrugated medium 14, secured between the outer and inner liners. A reinforcing strand 13 and a pair of reinforcing strands 20,21, are shown adhered between the outer liner and the corrugated medium. The curvilinear paths occupied by the reinforcing strands 13, 20, and 21 are preferably sinusoidally shaped in this embodiment. The paths defined by the reinforcing strands 20 and 21 are parallel sinusoidal curves. The reinforcing strand 20 is shown intersecting the reinforcing strand 13 at two points—22,23—in each alternate sinusoidal half period. Also, the reinforcing strands 20,21 are shown 180° out of phase with the reinforcing strand 13.

As used herein the term parallel, when applied to two or more curved paths, is intended to mean that essentially all points on one curve are essentially equidistant from corresponding points on the other curve or curves.

The reinforcing strands 13, 20, and 21 are shown generally disposed in the axial or machine direction of the corrugated paper product. The flutes of the corrugated medium 11 are usually in the cross machine direction and hence shown in the transverse direction in FIG. 3. In this example the preferred cross machine direction product width is 50 inches.

Figure 4:
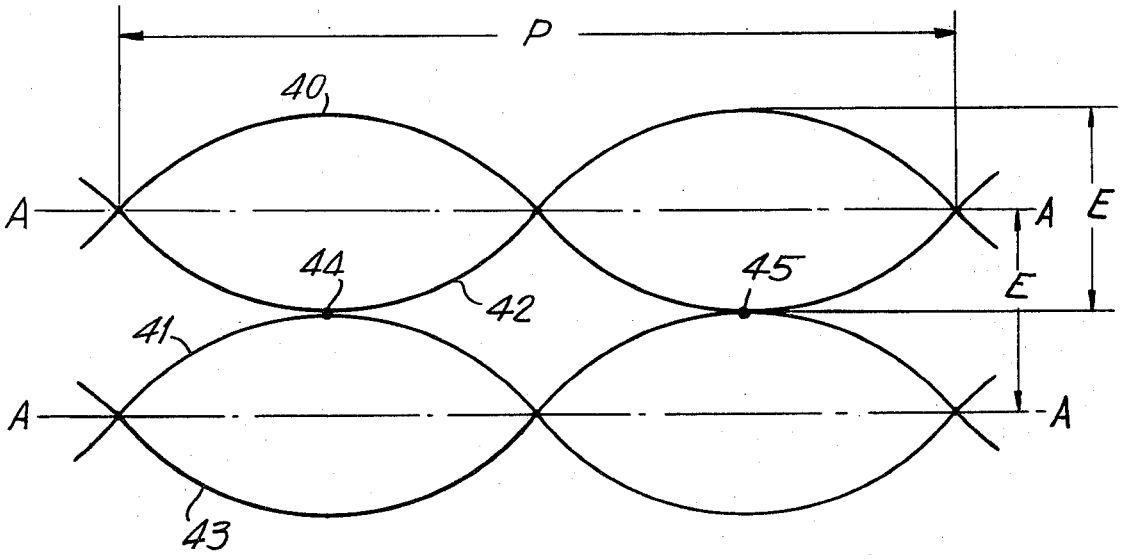
FIG. 4 illustrates one placement pattern for placing a plurality of reinforcing strands in accordance with principles of the invention.

Referring now to FIG. 4 which shows a pattern of reinforcing strand placement which can be advantageously used in accordance with the principles of the invention, a pair of parallel, in phase, sinusoidal paths 40 and 41 is shown. A second pair of parallel, in phase, sinusoidal paths 42 and 43 is also shown. The latter pair is 180° out of phase with respect to the first pair—40, 41. A peak-to-peak excursion E and a pair of parallel sinusoidal axes A-A are shown. Due to the phase relationships between the pairs 40,41 and 42,43, the sinusoidal axes A-A both serve as the sinusoidal axes of the pairs, 40, 41 and 42, 43. A common sinusoidal period P is shown for each of the paths 40, 41 and 42, 43. The axes A are shown displaced by a distance E, the peak-to-peak excursion, so that the path 42 tangentially intersects the path 41 at point 44 and the path 40 tangentially intersects the path 43 at point 45.

Reinforcing strands placed in accordance with the pattern of FIG. 4 are advantageous because they further reduce the likelihood of tear propagation and, should the bin experience a perforation failure, due, for example, to an impact with a sharp object, such failure will tend to be localized within an area bounded by the reinforcing strands.

In a bin having a width of about 35 inches and a height of about 40 inches, a preferred sinusoidal period P is 44 inches and a preferred peak-to-peak excursion E is about 6.5 inches.

At relatively low corrugating machine manufacturing speeds, an excursion E as high as 20 inches may be used. At the relatively higher speeds an excursion as low as 2 inches may be used. The sinusoidal period P may be varied from 22 to 100 inches, or more, depending upon the size of the bin. Up to a certain limit, the greater the E/P ratio, the greater is the effectiveness of the reinforcing strands. The recommended range for the ratio E/P is about 0.02 to about 0.45.

Figure 5:
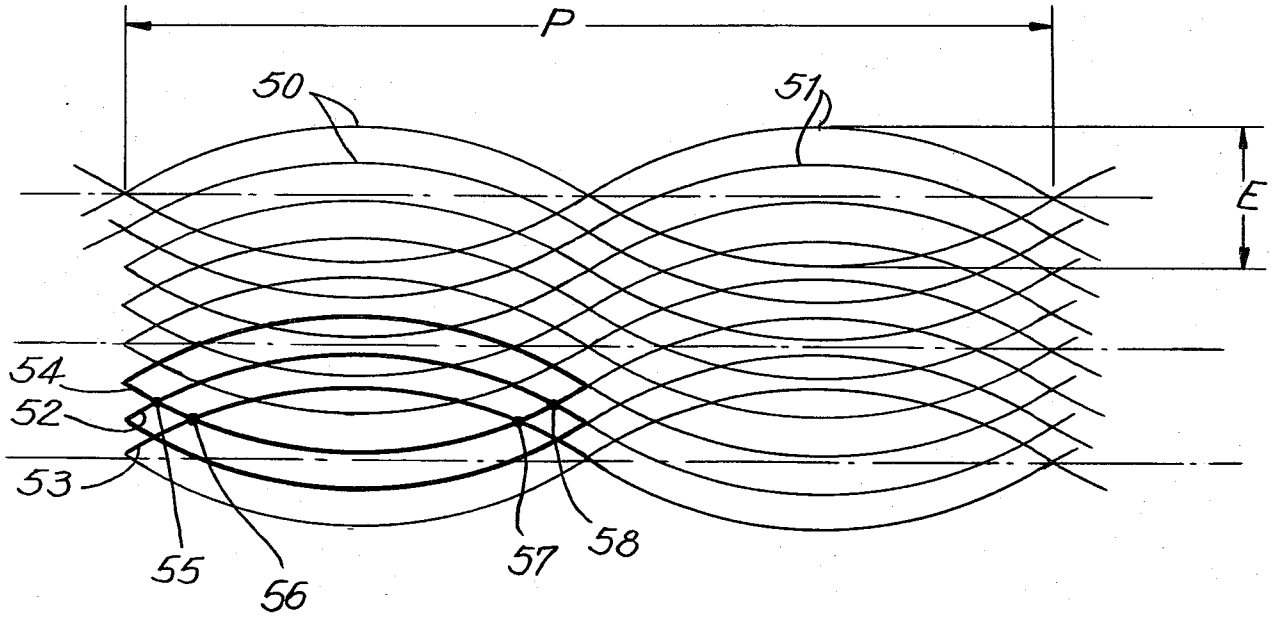
FIG. 5 illustrates an alternate pattern for placing a plurality of reinforcing strands in accordance with principles of the invention.

Referring now to FIG. 5 which shows yet another pattern of strand placement which can be advantageously used in accordance with the principles of the present invention, a first family of parallel sinusoidally arranged paths 50 for the reinforcing strands is shown. A second family 51, is shown, superimposed upon the first family and having the same peak-to-peak excursion and period as the first family. The second family is 180° out of phase with respect to the first family. Each of the strands in each family is equidistantly spaced apart from adjacent strands, a distance slightly less than $\frac{1}{3}$ of the excursion E.

Two reinforcing strands 52,53 of the first family are particularly shown intersecting one reinforcing strand 54 of the second family at points 55, 56, 57, and 58. It can be seen that the spacing between the strands illustrated in FIG. 5 results in two intersections of essentially each strand of the second family, eg, strand 54, with each of at least two strands of the first family, eg, 52,53, in alternate sinusoidal half periods. Also, each strand can be seen to have a total of 14 intersections in each sinusoidal period. The number of intersections can be varied by varying the spacing.

Figure 6:
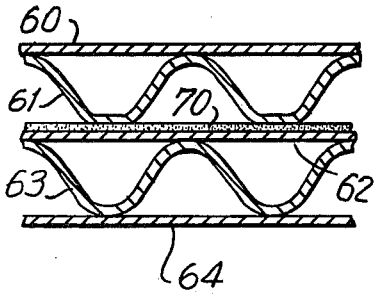
FIGS. 6, 7 and 8 are partial cross-sectional views which illustrate alternate placements of the reinforcing strands in a double walled corrugated paper product.
Figure 7:
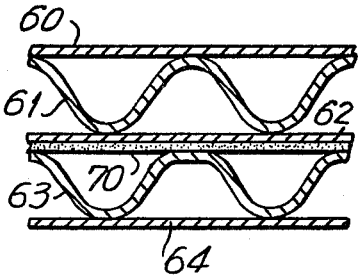
Figure 8:
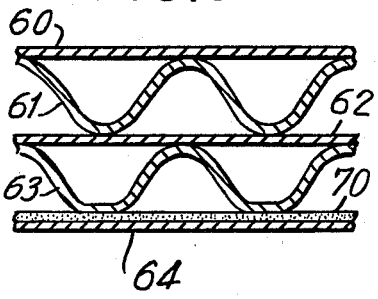

Referring collectively to FIGS. 6, 7, and 8, which show a double walled corrugated paper product in partial cross-sectional form, alternate placements of the reinforcing strands is illustrated. An inner liner 60 is provided to which is adhesively secured an inner corrugated medium 61. The inner corrugated medium is, in turn, adhered to an intermediate liner 62 which, in turn, is adhesively secured to an outer corrugated medium 63. An outer liner 64 is adhered to the outer corrugated medium. As briefly referred to above in reference to FIG. 2, the reinforcing strand or strands require at least one layer of corrugated medium between the strands and the interior of the bin in order to provide the energy absorbing characteristics of the invention. Accordingly, in FIG. 6, the reinforcing strands 70 are shown located between the inner corrugated medium and the intermediate liner. In FIG. 7 the reinforcing strands are shown between the intermediate liner and the outer corrugated medium. In FIG. 8 the reinforcing strands are shown positioned between the outer corrugated medium and the outer liner. Some reinforcing strands may be employed at one of the positions shown while others may be placed at other of the positions shown. Also, if more than one family of reinforcing strands is used, one family can be conveniently positioned in contact with the intermediate liner while the other family may be placed between the outer liner and the outer corrugated medium.

Figure 9:
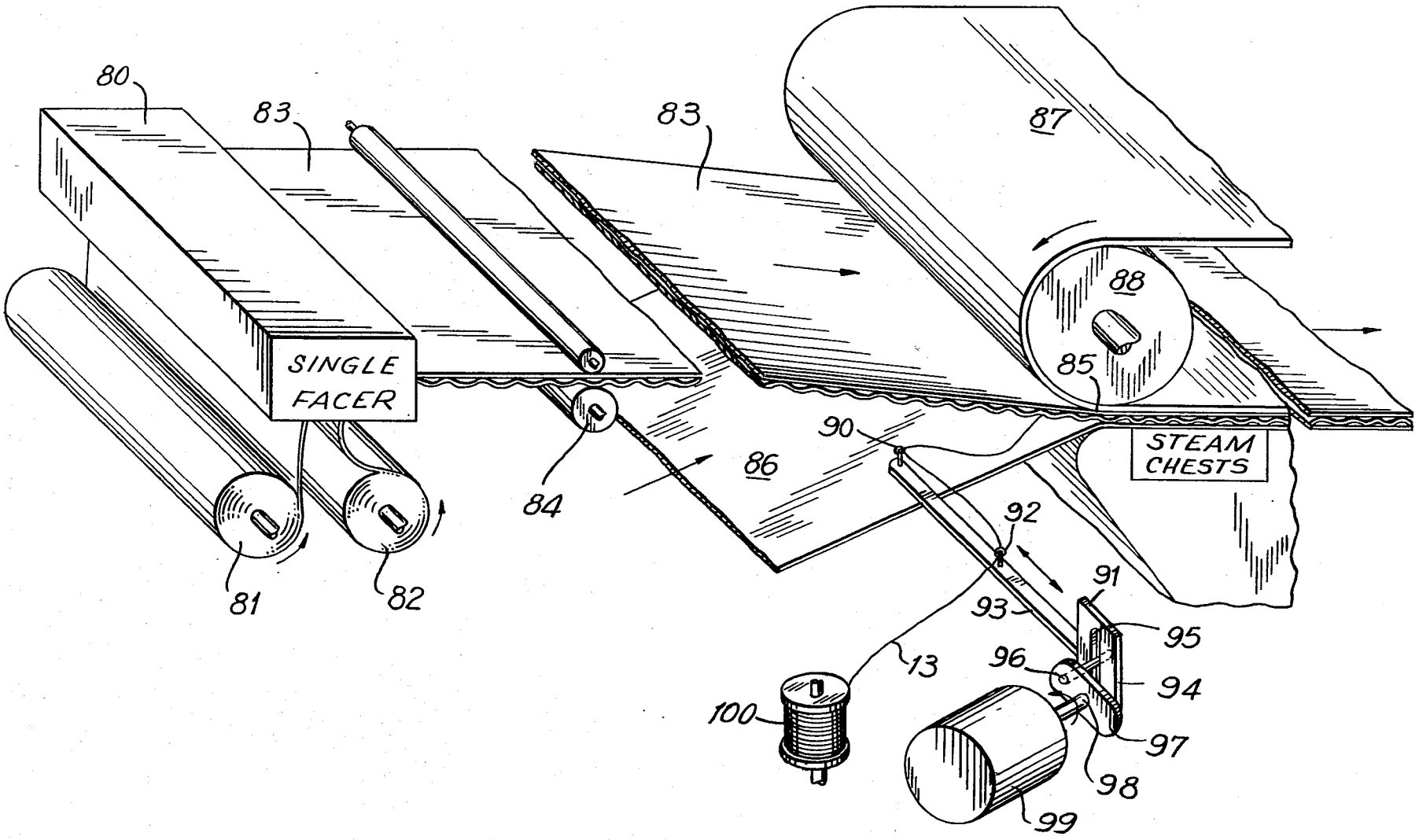
FIG. 9, partially in block diagram form, illustrates a method for making a corrugated paper product incorporating a reinforcing strand in accordance with principles of the invention.

Referring now to FIG. 9 which shows elements of basic apparatus and a method for making a reinforced corrugated paper product, a single facer section 80, of a conventional corrugating and combining machine, is schematically shown. A roll of liner board 81 continuously feeds liner to the single facer section. Also, a roll of uncorrugated medium 82 is shown continuously feeding the single facer section. The outlet of the single facer section 80 is single faced corrugated paper 83.

A conventional starch/water adhesive system is used for adhering the corrugated medium to the liner for providing the single faced corrugated paper. A further conventional adhesive applicator 84 is schematically shown applying adhesive to the exposed flutes of the single faced corrugated paper 83. The single faced corrugated paper is in turn continuously fed into a closure nip 85 into which is also continuously fed a second or outer liner 86 from a roll thereof, not shown. An endless belt 87 is shown passing over a roller 88 which defines the inlet to the closure nip 85. The endless belt 87 carries the single faced corrugated paper together with the outer liner through the closure nip and into the steam chest section of the machine. The closure nip and belt 87 are arranged to apply a small restraining pressure to hold the outer liner in place in the steam chest section while the starch adhesive sets.

In the angular space defined by the single walled corrugated paper 83 and the outer liner 86, is a feeding eye 90 of a reciprocating mechanism 91. The reciprocating mechanism 91 includes a second feeding eye 92 mounted on a reciprocating arm 93. The feeding eye 90 is mounted on the machine side of the reciprocating arm 93. The reciprocating mechanism also includes a yoke 94 having an elongated drive slot 95 engaged by a pin 96 on a driving plate 97 which is, in turn, mounted on a shaft 98. The shaft 98 is an output shaft of a combination motor gear box 99. Restraining means, not shown, are provided for permitting the reciprocating arm 93 to move only linearly in a direction transverse to the machine direction. As the shaft 98 rotates the drive pin 96, acting through the yoke mechanism 94 imparts a sinusoidal reciprocating motion to the reciprocating arm 93.

A thermoplastic coated reinforcing strand 13 is fed through the feeding eyes 90, 92 from a spool 100. The reinforcing strand 13 is thus deposited in a sinusoidal pattern between the outer liner 86 and the single faced corrugated paper 83.

As the product combination progresses into the closure nip, it is exposed to a mild pressure as discussed above and the conventional temperature experienced in the steam chest section of the machine. The temperatures may be in the range of about 250° F. to 400° F. As a result, the thermoplastic coating on the strand 13 is caused to soften resulting in adhesion of the strand with the liner 86 and with the peaks of the flutes of the single faced corrugated paper 83.

Because the feeding eye 90 cannot be placed directly in the closure nip 85, a certain portion of the reciprocating motion will be lost. Therefore, it is necessary to reciprocate the arm 93 through an excursion in excess of the desired sinusoidal excursion of the deposited reinforcing strand. To obtain a peak-to-peak excursion of 6 inches, we have found it necessary to reciprocate the arm 93 a total of about 8 inches. We have also found it necessary to vary the excursion of the arm 93 with the speed of the machine to obtain a desired peak-to-peak excursion of the deposited reinforcing strand.

If it is desired to include a plurality of reinforcing strands, a plurality of feeding eyes can easily be incorporated on the reciprocating arm 93 and fed from a plurality of separate spools. Also, if it is desired to provide a second family of reinforcing strands which is out of phase with respect to the first family, such a second family can be deposited by the use of a second reciprocating arm driven by the shaft 98 but 180° out of phase with the movement of the reciprocating arm 93. Such a second reciprocating arm can in turn be fed by a separate plurality of strands from separate spools in the manner described above.

It can be seen that a single strand can be selectively placed at one end of the manufactured corrugated paper product or one or more families of reinforcing strands can be selectively deposited in any portion of the corrugated paper product or throughout the product.

While the invention has been described with a certain degree of particularity, it will be understood by those skilled in the art that many modifications and variations thereof can be made without departing from the true spirit and scope of the invention.

We claim:

1. A reinforced corrugated paper container for containing generally heavy articles comprising:

a bottom wall;

a plurality of side walls in excess of four forming a generally polygonal configuration and defining the periphery of said container; an outer liner for defining the outer liner of said side walls;

an inner liner;

a corrugated medium adhesively secured between said outer liner and said inner liner, said corrugated medium having its flutes extending generally in a vertical direction; and a family of reinforcing strands between said outer liner and said corrugated medium in adhesive contact with the crests of said flutes of said corrugated medium, in essentially continuous adhesive contact with said outer liner and spaced from the valley between adjacent crests of said flutes along substantially the entire periphery of said container, said reinforcing strands being so positioned as to define a family of generally parallel curvilinear paths extending along said periphery, whereby when said container contains articles sufficiently heavy to cause distortion of said side walls thereof, said container tends to become circularized and said reinforcing strands exert a restraining force having a first vector component normal to the plane of one of said side walls and a second vector component generally parallel to said plane and said reinforcing strands distort said medium resulting in the absorption of energy before said container fails.

2. The reinforced corrugated paper container of claim 1 wherein said curvilinear path defined by said reinforcing strands is a sinusoid.

3. The reinforced corrugated paper container of claim 2 wherein said reinforcing strands are comprised of unspun fibres having a tensile strength, prior to being adhered between said outer liner and said corrugated medium, in the range of 20 to 60 pounds, and wherein said sinusoid has a peak-to-peak excursion in the range of b 2 to 20 inches and a period in the range of 22 to 100 inches.

4. The reinforced corrugated paper container of claim 2 further comprising:

a second family of reinforcing strands between said outer liner and said corrugated medium in adhesive contact with the crests of said flutes of said corrugated medium, in essentially continuous adhesive contact with said outer liner and spaced from the valley between adjacent crests of said flutes along substantially the entire periphery of said container, said second family of reinforcing strands being so positioned as to define a second family of essentially parallel continuous and essentially sinusoidally shaped paths, said second family being 180° out of phase with respect to said first family, having a period essentially the same as the period of said first family, and said reinforcing strands of said second family being superimposed upon said reinforcing strands of said first family to provide at least one intersection of essentially each strand of said second family with at least one strand of said first family in essentially each sinusoidal half-period of said second family.

5. The reinforced corrugated paper container of claim 4 wherein said second family is superimposed upon said first family to provide at least two intersections of essentially each strand of said second family with each of at least two strands of said first family in essentially each alternate sinusoidal half-period of said second family.

6. A double walled reinforced corrugated paper container comprising:

a bottom wall;

a plurality of side walls in excess of four forming a generally polygonal configuration and defining the periphery of said container;

an inner liner for defining the inner liner of said side walls;

an intermediate liner, having an inner surface and an outer surface;

an inner corrugated medium adhesively secured between said inner liner and said inner surface of said intermediate liner and having its flutes extending generally in a vertical direction;

an outer liner for defining the outer liner of said side walls;

an outer corrugated medium adhesively secured between said outer surface of said intermediate liner and said outer liner, said outer corrugated medium having its flutes extending generally in a vertical direction; and a plurality of reinforcing strands in essentially continuous adhesive contact with one of said inner and outer surfaces of said intermediate liner, in adhesive contact with the crests of said flutes of one of said inner and outer corrugated mediums and spaced from the valley between adjacent crests of said flutes along substantially the entire periphery of said container, said reinforcing strands being in a position as to define a family of essentially parallel continuous sinusoidal paths extending along said periphery, whereby when said container contains articles sufficiently heavy to cause distortion of said side walls thereof, said container tends to become circularized and said reinforcing strands exert a restraining force having a first vector component normal to the plane of one of said side walls and a second vector component generally parallel to said plane, and said reinforcing strands distort said outer medium resulting in the absorption of energy before said container fails.

7. A double walled reinforced corrugated paper container comprising:

a bottom wall;

a plurality of upstanding side walls in excess of four forming a generally polygonal configuration and defining the periphery of said container;

an inner liner for defining the inner liner of said side walls;

an intermediate liner having an inner surface and an outer surface;

an inner corrugated medium adhesively secured between said inner liner and said inner surface of said intermediate liner and having its flutes extending generally in a vertical direction;

an outer liner for defining the outer liner of said side walls;

an outer corrugated medium adhesively secured between said outer surface of said intermediate liner and said outer liner and having its flutes extending generally in a vertical direction;

a first plurality of reinforcing strands between said outer corrugated medium and said outer liner in adhesive contact with the crests of said flutes of said outer corrugated medium, in essentially continuous adhesive contact with said outer liner and spaced from the valley between adjacent crests of said flutes of said outer corrugated medium along substantially the entire periphery of said container, said reinforcing strands being so positioned as to define a first family of essentially parallel continuous and essentially sinusoidal paths extending generally in said peripheral direction; and a second plurality of reinforcing strands between said outer liner and said outer corrugated medium in adhesive contact with the crests of said flutes of said outer corrugated medium, in essentially continuous adhesive contact with said outer liner and spaced from the valley between adjacent crests of said flutes of said outer corrugated medium along substantially the entire periphery of said container, said second plurality of reinforcing strands being so positioned as to define a second family of essentially parallel continuous and essentially sinusoidally shaped paths extending generally in said peripheral direction, said second family being 180° out of phase with respect to said first family, having a period essentially the same as the period of said first family, and said reinforcing strands of said second family being superimposed upon said reinforcing strands of said first family to provide at least two intersections of essentially each strand of said second family with each of at least two strands of said first family in essentially each sinusoidal half-period of said second family whereby when said container contains articles sufficiently heavy to cause distortion of said side walls thereof, each of said reinforcing strands exerts a restraining force having a first vector compnent normal to the plane of one of said side walls and a second vector component generally parallel to said plane, and said reinforcing strands distort said outer medium resulting in the absorption of energy before said container fails.

* * * * *